US007778586B2

(12) United States Patent
Meyer et al.

(10) Patent No.: US 7,778,586 B2
(45) Date of Patent: Aug. 17, 2010

(54) WASTE TONER SOLIDIFICATION APPARATUS FOR A PRINTING DEVICE

(75) Inventors: Brent L. Meyer, Boise, ID (US); Bartley Mark Hirst, Boise, ID (US); Thomas Wayne Ives, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 404 days.

(21) Appl. No.: 11/931,894

(22) Filed: Oct. 31, 2007

(65) Prior Publication Data

US 2009/0110455 A1 Apr. 30, 2009

(51) Int. Cl.
*G03G 21/00* (2006.01)

(52) U.S. Cl. ..... 399/358; 399/35

(58) Field of Classification Search ..... 399/35, 399/120, 264, 358

See application file for complete search history.

(56) References Cited

U.S. PATENT DOCUMENTS

| | | | |
|---|---|---|---|
| 3,924,566 | A | 12/1975 | Dennie |
| 4,436,414 | A | 3/1984 | Kamiyama et al. |
| 5,136,338 | A | 8/1992 | Greenaway et al. |
| 7,099,617 | B2 | 8/2006 | Jeong et al. |
| 2005/0117945 | A1 | 6/2005 | Lee |

FOREIGN PATENT DOCUMENTS

| | | | |
|---|---|---|---|
| JP | 63153571 | | 6/1988 |
| JP | 63289575 | | 11/1988 |
| JP | 03028875 | | 2/1991 |
| JP | 06130869 | | 5/1994 |
| JP | 06-186893 | A | 7/1994 |
| JP | 06186893 | | 7/1994 |
| JP | 07-140871 | A | 6/1995 |
| JP | 07140871 | | 6/1995 |
| JP | 07-168491 | A | 7/1995 |
| JP | 07168491 | | 7/1995 |
| JP | 07-295446 | A | 11/1995 |
| JP | 07295446 | | 11/1995 |
| JP | 07-334052 | A | 12/1995 |
| JP | 09006207 | | 1/1997 |
| JP | 2001042716 | | 2/2001 |
| JP | 2005120112 | | 5/2005 |
| JP | 2005309246 | | 11/2005 |

OTHER PUBLICATIONS

Machine translation of JP-06-186893.*

International Search Report. Mail Date May 28, 2009. International Application No. PCT/US2008/081266. Filing Date Oct. 27, 2008.

* cited by examiner

*Primary Examiner*—David M Gray
*Assistant Examiner*—G. M. Hyder

(57) ABSTRACT

A waste toner solidification apparatus for a printing device includes a nozzle configured to receive waste toner from a hopper. A heater is configured to heat the waste toner in a manner sufficient to liquefy the waste toner within the nozzle. Substantially when exiting the nozzle, the liquefied waste toner solidifies and forms a plurality of solid waste toner pellets.

23 Claims, 2 Drawing Sheets

WASTE TONER SOLIDIFICATION APPARATUS FOR A PRINTING DEVICE

BACKGROUND

The present disclosure relates generally to printing devices and, more particularly, to a waste toner solidification apparatus for a printing device.

In electrophotographic (EP) printing, an electrostatic latent image is formed on a photosensitive medium of a printing device, where the photosensitive medium is charged to a predetermined potential via exposure to light produced from an exposure unit. The electrostatic latent image is developed using a developer or toner to then form a toner image. The toner image is established on a printing surface such as, e.g., paper, and is fused thereto via a fuser employed within the printing device.

In some instances, EP printing is accomplished using a powderized toner to develop the electrostatic latent images. However, during transfer of the toner to the photosensitive medium, residual or waste toner may accumulate on the photosensitive medium. This accumulated waste toner may disadvantageously adhere to the printing surface during subsequent printing, thereby potentially reducing the quality of subsequently printed images.

BRIEF DESCRIPTION OF THE DRAWINGS

Features and advantages of embodiment(s) of the present disclosure will become apparent by reference to the following detailed description and the drawings, in which like reference numerals correspond to similar, though perhaps not identical components. Reference numerals having a previously described function may or may not necessarily be described in connection with other drawings in which they appear.

DETAILED DESCRIPTION

Embodiment(s) of the waste toner solidification apparatus as disclosed herein advantageously allow removal of waste toner from a printing device in a substantially convenient and relatively clean manner. This is accomplished by forming solid pellets of the waste toner in the waste toner solidification apparatus and collecting the pellets in a waste container to facilitate removal thereof from the printing device. The solid pellets are removed from the waste container, and the waste container may then be reused. Further, the waste toner is solidified via heating using an external heating source, i.e., a heating source other than the fuser employed by the printing device. Using waste heat from the fuser may cause the waste toner to solidify in feed tubes, thereby requiring more complex mechanical systems. It is believed that an external heating source substantially simplifies the design of the waste toner solidification apparatus, substantially reduces the amount of power required to power the external heater, and also substantially reduces the time required to heat the powderized waste toner to form the individual pellets. Furthermore, the waste toner solidification apparatus may advantageously be located in any desirable location in the printing device, and is not limited by the location of the fuser.

Figure 1:
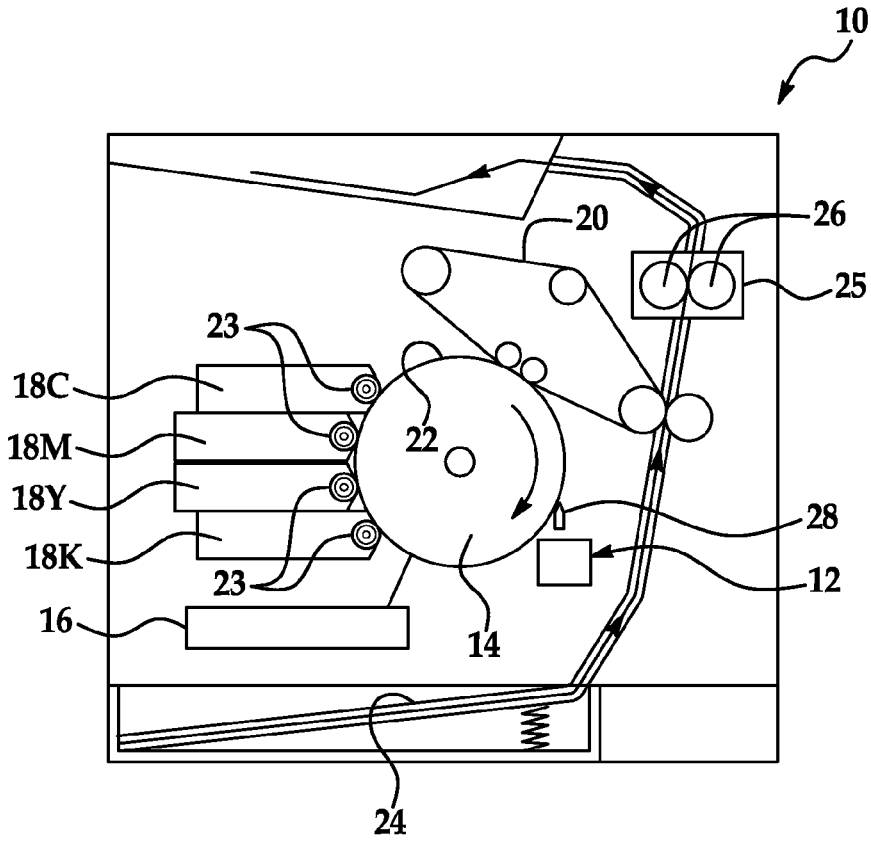
FIG. 1 is a schematic representation of an electrophotographic printing device including an embodiment of a waste toner solidification apparatus as disclosed herein.

A printing device 10 including a waste toner solidification apparatus 12 is schematically depicted in FIG. 1. For illustrative purposes, the printing device 10 will be described as an electrophotographic color printer, but is not intended to be limited thereto. It is to be understood that the waste toner solidification apparatus 12 may also be used for electrophotographic black and white printers, optical photocopiers, mono printing devices, and/or other printing devices using powderized toner material.

As shown in FIG. 1, the printing device 10 may include a photosensitive drum 14, an exposure unit 16, four developing units 18C, 18M, 18Y, 18K and a transfer belt 20. The photosensitive drum 14 is a cylindrically-shaped drum including a photoconductive layer (not shown) formed on an outer surface 22 of the drum 14. The photoconductive layer is substantially uniformly charged to a predetermined potential, where charging may be accomplished using a charger (not shown).

The exposure unit 16 is disposed substantially adjacent to the photosensitive drum 14 and is used for forming an electrostatic latent image thereon. The exposure unit 16 accomplishes this by scanning a light that corresponds to an image on the photosensitive drum 14. The exposure unit 16 may include, but is not limited to, a laser scanning unit (LSU), a light emitting diode (LED), moving mirrors which scan a light source across the source image and send the reflected light to the photosensitive drum, and/or the like.

For color EP (electrophotographic) printing, several developing units may be used in the printing device 10, e.g., a developing unit 18C for cyan toner particles, a developing unit 18M for magenta toner particles, a developing unit 18Y for yellow toner particles, and a developing unit 18K for black toner particles. As shown in FIG. 1, each of the developing units 18C, 18M, 18Y, 18K includes a developing roller 23 that supplies the toner particles to the electrostatic latent image formed on the photosensitive drum 14, whereby a toner image on the drum 14 is formed from each developing unit 18C, 18M, 18Y, 18K. Each of these toner images are transferred to the transfer belt 20, which is disposed in the printing device 10 substantially adjacent to the drum 14. When the toner images contact the transfer belt 20, the toner images overlap to form a single multi-colored toner image on the transfer belt 20.

The multi-colored toner image is thereafter transferred to a printing surface 24 (e.g., a sheet of paper) and is fixed thereto via a fuser 25. In a non-limiting example, the fuser 25 includes two rollers 26 that rotate into engagement with each other at a predetermined pressure. At least one of the rollers 26 includes a heating unit (not shown) that is used to heat the multi-colored toner image. As the printing surface 24 passes through the fuser 25, the multi-colored toner image is fixed or otherwise established on the printing surface 24 via pressure and heat applied thereto from the rollers 26 of the fuser 25.

In an embodiment, and as shown in FIG. 1, the waste toner solidification apparatus 12 is disposed in the printing device 10 substantially adjacent to the photosensitive drum 14 and is used to collect and solidify substantially powderized waste toner that may have accumulated on the photosensitive drum 14 during transfer of the toner image(s) from the drum 14 to the transfer belt 20. In another embodiment, and not shown in FIG. 1, the waste toner solidification apparatus 12 may be disposed in the printing device 10 substantially adjacent to the transfer belt 20 and collects substantially powderized waste toner that may have accumulated on the transfer belt 20. It is to be understood that other embodiments may also be employed, for example, two waste toner solidification apparatuses 12 may be used in the printing device, where the drum 14 and the transfer belt 20 each have their own apparatus 12, or a single apparatus 12 may be used to remove and collect waste toner from both the drum 14 and the transfer belt 20.

Figure 2:
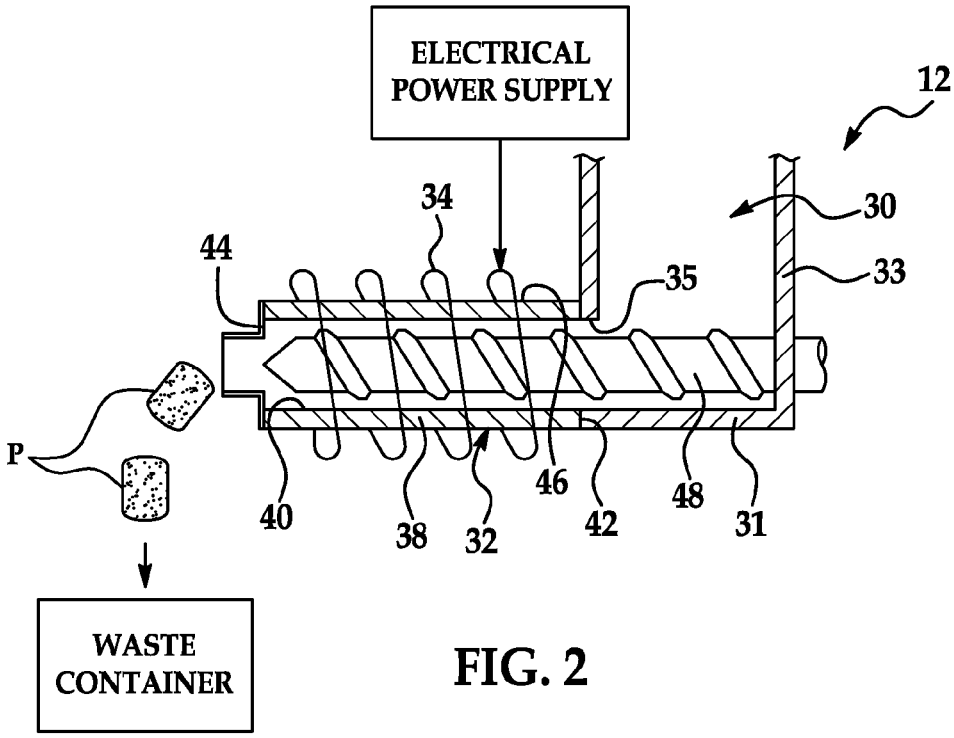
FIG. 2 is a semi-schematic, cross-sectional side view of the waste toner solidification apparatus of FIG. 1.
Figure 3:
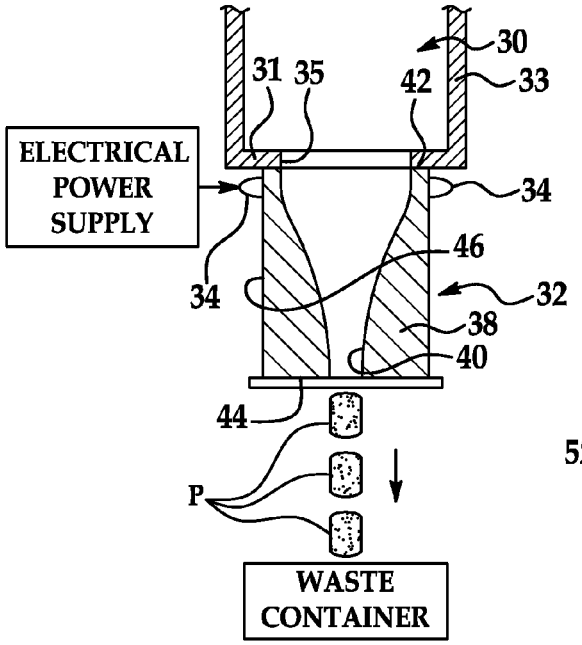
FIG. 3 is a semi-schematic, cut-away cross-sectional side view of yet another embodiment of the waste toner solidification apparatus of FIG. 1.

As used in the printing device 10, the waste toner solidification apparatus 12 collects the substantially powderized waste toner, liquefies the powderized waste toner, and solidifies the waste toner into relatively small solid waste toner pellets (identified by reference character P in FIGS. 2 and 3). The pellets P are thereafter deposited and collected in a waste container. The waste container may be removed from the printing device 10, and the pellets P may then be removed from the waste container and disposed of. Alternatively, the pellets P may be removed from the waste container without having to remove the waste container from the printing device 10.

It is to be understood that the waste toner solidification process employed by the waste toner solidification apparatus 12 advantageously forms the solid pellets P of waste toner in a substantially clean manner and further does not use liquification and/or solidification agents to perform any of the waste toner solidification process steps as recited herein. Thus, substantially no foreign debris including dust particles or chemicals are formed in the pellets P, and the pellets P may be recycled as opposed to being disposed of. Further, the pellets P are formed prior to entering the waste container and thus do not substantially adhere to the waste container. As such, the waste container may also be reused if desired.

In an embodiment, and with reference to FIGS. 1 and 2 together, the waste toner solidification apparatus 12 includes a hopper 30 having a base 31 and a wall 33 with an outlet 35 formed in the wall 33. The hopper 30 is generally configured to receive and collect the powderized waste toner that may have accumulated on the drum 14 and/or the transfer belt 20 during the toner image forming process. In an embodiment, the hopper 30 may receive the powderized waste toner from the drum 14 and/or the transfer belt 20 via a cleaning device 28 (shown in FIG. 1). In a non-limiting example, the cleaning device 28 is a blade or any other suitable device configured to scrape the outer surface 22 of the drum 14 and/or the transfer belt 20, thereby removing the accumulated powderized waste toner therefrom. As the powderized waste toner is removed, the waste toner falls or is guided into the hopper 30.

The waste toner solidification apparatus 12 further includes a nozzle 32 having a body 38 of a desired length and a cavity 40 formed in the body 38. In an embodiment, the body 38 may be formed of any suitable heat resistant material that generally does not adhere to the waste toner particles. A non-limiting example of such a material is stainless steel. In some embodiments, it may be desirable to coat the interior of the nozzle 32 with a non-stick material, such as TEFLON® (E.I. Du Pont de Nemours and Co., Wilmington, Del.). The length of the body 38 may be selected based on, at least in part, the desirable flow rate, thermal mass, toner feed rate, and dwell time sufficient to melt the toner. In a non-limiting example, the length of the body 38 ranges from about 1" (2.54 cm) to about 3" (7.62 cm).

It is to be understood that the cavity 40 formed in the body 38 of the nozzle 32 may be of any suitable size and shape. In an embodiment (e.g., as depicted in FIG. 2), the cavity 40 is substantially cylindrically shaped and has a substantially consistent diameter from a first end 42 of the nozzle 32 to a second end 44 of the nozzle 32. In a non-limiting example, the cavity 40 size/diameter may be substantially the same as the size/diameter of the solid waste toner pellets P formed by the waste toner solidification apparatus 12.

The hopper 30 may be connected to (e.g., via any suitable mechanical attachment or fastener), or integrally formed with the nozzle 32. The cavity 40 is generally aligned with the outlet 35 of the hopper 30. As shown in FIG. 2, the outlet 35 is formed in the wall 33 of the hopper 30 near the bottom thereof, and the nozzle 32 may be oriented substantially perpendicularly with respect to the base of the hopper 30. However, it is to be understood that the nozzle 32 may be offset from hopper 30 at any desired angle.

In an embodiment in which the hopper 30 is formed integrally with the nozzle, the apparatus 12 may be formed of a thin walled stainless steel tube that has one end heated and includes a transport device 48 to push the waste toner through the tube. In this embodiment, the hopper 30 is an inlet bore formed into the side wall of the tube such that waste toner may be supplied to the tube and onto the transport device 48. The transport device 48 then pushes the waste toner toward the heated portion of the tube to be melted and extruded out of the tube into a waste container.

In an embodiment, a transport device 48 is disposed in the cavity 40 and extends through the hopper 30 and into the nozzle 32. The transport device 48 is generally configured to move the powderized waste toner from the hopper 30 and through the nozzle 32. It is to be understood that the transport device 48 may extend at least partially through the nozzle 32 or may extend through the entire length of the nozzle 32. It is to be further understood that extending the transport device 48 through the entire length of the nozzle 32 (as depicted in FIG. 2) advantageously substantially prevents packing of the waste toner particles in nozzle 32. Non-limiting examples of suitable transport devices 48 include screws, augers, and/or the like, where the powderized waste toner is moved through the nozzle 32 via rotational movement of the transport device 48.

Figure 2A:
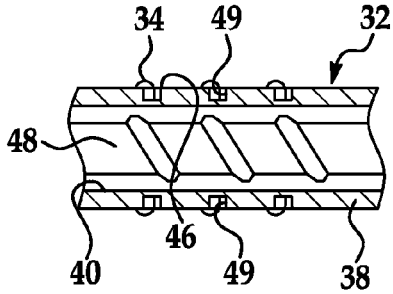
FIG. 2A is a cut-away, cross-sectional side view of another embodiment of the waste toner solidification apparatus of FIG. 1.

The waste toner solidification apparatus 12 further includes an external heater 34 surrounding at least a portion of the nozzle 32. In a non-limiting example, the external heater 34 is a wire (e.g., a Nichrome wire or any other mechanically, chemically and electrically robust wire) wrapped around at least a portion of an outer surface 46 of the nozzle body 38, and connected to an electrical power supply. In another non-limiting example, as shown in FIG. 2A, the outer surface 46 of the nozzle body 38 may have a plurality of grooves 49 formed therein, with the wire 34 disposed in the grooves 49. In still other non-limiting examples, an induction coil wrapped around at least a portion of the outer surface of the nozzle body 38, a resistive heating element plated on the nozzle body 38, or an incandescent lamp may be used as the heater 34.

The external heater 34 is generally configured to heat the nozzle 32 to a temperature sufficient to liquefy the powderized waste toner traveling through the nozzle 32. In an embodiment, the average power applied to the nozzle 32 from the external heater 34 ranges from about 5 W to about 7 W. Such power generally results in temperatures ranging from about 150° C. to about 170° C., which are believed to be sufficient to melt the powdered toner to liquid form. It is to be understood that configuring nozzle 32 with a sufficiently small thermal mass allows for system operation with a relatively small amount of power (e.g., from about 5 W to about 10 W), and, thus, the nozzle 32 may be substantially thoroughly heated and molten toner may be provided for extrusion in less than about 30 seconds. In laser printing systems, it may be desirable to run an entire cycle in as short a time as reasonably possible, with target times ranging from about 10 seconds to 1 minute.

Figure 4:
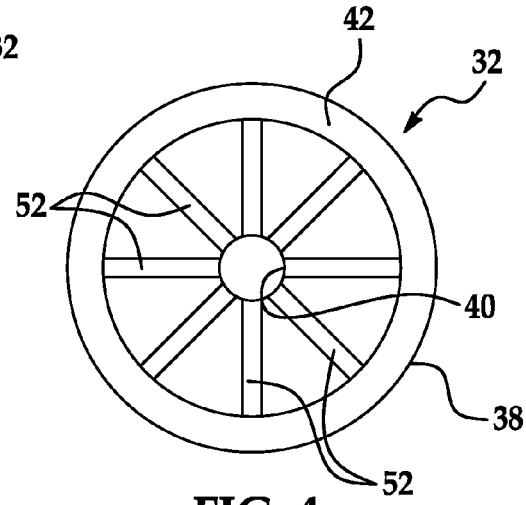
FIG. 4 is a schematic top view of the waste toner solidification apparatus of FIG. 3.

Another embodiment of the waste toner solidification apparatus 12 is depicted in FIGS. 3 and 4. In this embodiment, the nozzle 32 extends substantially outwardly from the base of the hopper 30 (i.e., the nozzle 32 is not substantially angularly offset from the hopper 30). The outlet 35 of the hopper 30 is substantially aligned with the cavity 40 of the nozzle 32. Due to the substantial vertical arrangement of the hopper 30 and the nozzle 32, the powderized waste toner collected in the hopper 30 is generally delivered to the nozzle 32 via gravity, thereby substantially obviating the need for a transport device 48. It is to be understood, however, that a transport device 48 may be employed in this embodiment if desired. A non-limiting example of a transport device 48 suitable for use in this embodiment is a plunger.

As shown in FIG. 3, the cavity 40 is substantially conically shaped, where the diameter of the cavity 40 at the first end 42 of the nozzle 32 is larger than the diameter of the cavity 40 at the second end 44 of the nozzle 32. In the presence of gravity, the conically shaped cavity 40 facilitates movement of the powderized waste toner through the nozzle 32 via a funnel effect, thereby sufficiently moving the waste toner through the nozzle 32. In an embodiment, the cavity 40 may be configured with a larger orifice and a funnel shaped lower portion having reduced wall thickness, which are believed to enhance movement of the waste toner through the nozzle 32 without the use of a transport device 48. The larger orifice is also believed to decrease the effects of viscosity and surface tension, thereby allowing molten toner drops to form. In this embodiment, gravity and cooling of the molten drops form the pellets P.

In the embodiment shown in FIGS. 3 and 4, the external heater 34 may be wrapped around the outer surface 46 of the nozzle 32 at the first end 42 near the top of the vertically arranged nozzle 32, or may be disposed within grooves (not shown) formed in at least a portion of the outer surface 46, similar to the embodiment depicted in FIG. 2A. Since the body 38 of the nozzle 32 has a thickness that is substantially larger nearest the second end 44 of the nozzle 32, wrapping the external heater 34 around the entire length of the nozzle 32 may not, in some instances, provide enough heat to be transferred through the nozzle body 38 to suitably heat and liquefy the waste toner traveling through the cavity 40. Thus, a plurality of heat transfer surfaces 52 (e.g., metal fins) may be disposed in the nozzle body 38 (as depicted in FIG. 4), where the heat transfer surfaces 52 are positioned substantially radially from the cavity 40. Inclusion of the heat transfer surfaces 52 generally allows heat to substantially efficiently and effectively melt or otherwise liquefy the powderized waste toner traveling through the nozzle 32. It is to be understood that the heat transfer surfaces 52 may be shrunk such that outer surface 38 is parallel to the cavity 40. It is believed that this reduces or eliminates the thermal mass and the resulting time delay in heating, while increasing heat that is available at the orifice to liquefy the toner.

In one non-limiting example, both the nozzle 32 and the heat transfer surfaces 52 are formed of aluminum.

Figure 5:
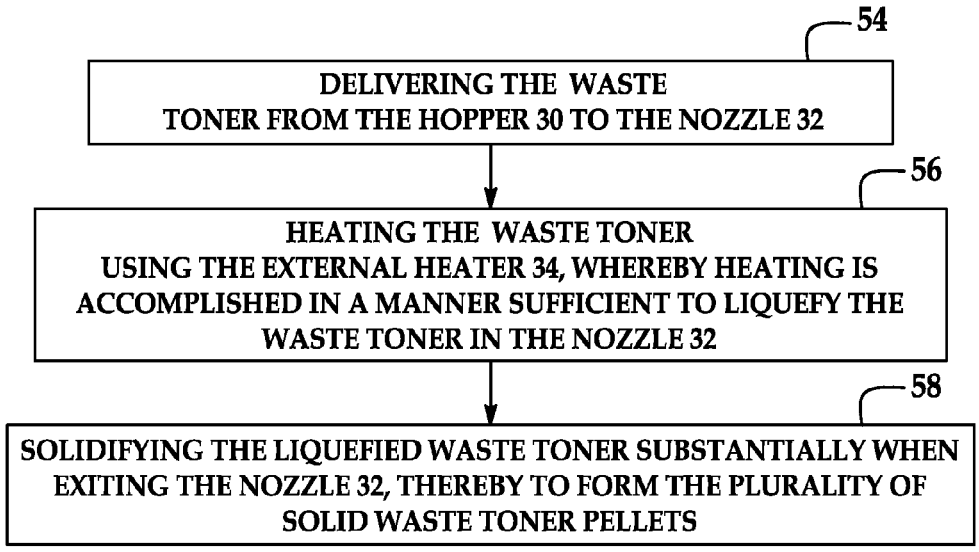
FIG. 5 is a flow diagram of an embodiment of a method of removing waste toner using the waste toner solidification apparatus of FIG. 1.

An embodiment of the method of removing waste toner from the printing device 10 is schematically depicted in FIG. 5. The method generally includes delivering waste toner (e.g., substantially powderized waste toner) from the hopper 30 to/through the nozzle 32 (Block 54). In a non-limiting example, delivering may be accomplished by rotating the transport device 48 using the embodiment of the apparatus 12 as depicted in FIG. 2. In another non-limiting example, delivering may be accomplished via gravity using the embodiment of the apparatus 12 depicted in FIGS. 3 and 4. The method further includes heating the waste toner using the external heater 34, whereby heating is accomplished in a manner sufficient to liquefy the waste toner in the nozzle 32 (Block 56); and solidifying the liquefied waste toner substantially when exiting the nozzle 32, thereby to form a plurality of solid waste toner pellets (Block 58).

It is to be understood that the waste toner solidification process employed by the waste toner solidification apparatus 12 shown in FIG. 2 forms solid waste toner pellets P via incremental operation. In a non-limiting example, the liquefied waste toner travels through the nozzle 32 for an increment of time and then stops for an increment of time. During this stopping period, air that is trapped inside the cavity 40 of the nozzle 32 is outgassed. Without being bound by any theory, it is believed that the outgassing of the air contributes to moving the liquefied waste toner through and out of the nozzle 32.

In still another embodiment, separation of the melted toner from the nozzle 32 is accomplished via toner feed time control in which the on/off ratio of the feed motor is controlled. This allows the waste toner to be fed by the transport device 48 into the nozzle 32. The feed is then turned off, and the toner melts inside nozzle 32. Air trapped with the toner collects into a bubble, which forces the molten toner out of the nozzle 32 end until the bubble pops, at which time the transport device 48 may again be turned on to feed more waste toner to be melted.

As used herein, the term "substantially when exiting the nozzle 32" means that the liquified waste toner is in a position suitable for solidification to take place. This position may be, for example, near the second end 44 of nozzle 32, either on the inside or outside of nozzle 32.

The waste toner removal method may further include cooling the liquefied waste toner upon exiting the nozzle 32 to thereby substantially instantaneously solidify the liquefied waste toner. It is to be understood that the liquified toner may solidify upon exposure to air (which cools the toner) as it exits the nozzle 32. In one non-limiting example, exposure may begin near the second end 44, either on the inside or outside of the nozzle 32. It is to be understood that while exposure may begin near the second end 44 inside the nozzle 32, such exposure is generally not sufficient to fully solidify the liquified toner while inside the apparatus 10. The time for solidification depends, at least in part, on the external temperature to which the liquefied waste toner is exposed. In a non-limiting example, the solidification time ranges from about 1 second to about 3 seconds at a temperature ranging from about 20° C. to about 40° C. In another non-limiting example, the solidification time is equal to or less than about 2 seconds at ambient temperature. Cooling may be accomplished by simply exposing the liquefied waste toner to ambient temperature, by using an external cooler (e.g., a fan), or combinations thereof.

After solidification of the liquefied waste toner, the solid waste toner is removed from the nozzle 32 and deposited into the waste container. In an embodiment, removal of the solid waste toner pellets is accomplished by using a removal device (e.g., a blade) to remove portions of the solid waste toner from the nozzle 32, thereby forming solid pellets of desired size. In another embodiment, the solid pellets may be removed by gravity, for example, in the embodiment shown in FIG. 3, or if the transport device 48 is properly controlled. In the embodiment depicted in FIG. 2, removal of the solid waste toner pellets may also be accomplished by reversing the rotational movement of the transport device 48.

It is to be understood that the term "connect/connected" is broadly defined herein to encompass a variety of divergent connection arrangements and assembly techniques. These arrangements and techniques include, but are not limited to (1) the direct connection between one component and another component with no intervening components therebetween; and (2) the connection of one component and another component with one or more components therebetween, provided that the one component being "connected to" the other component is somehow operatively connected to the other component (notwithstanding the presence of one or more additional components therebetween).

While several embodiments have been described in detail, it will be apparent to those skilled in the art that the disclosed embodiments may be modified and/or other embodiments may be possible. Therefore, the foregoing description is to be considered exemplary rather than limiting.

What is claimed is:

1. A waste toner solidification apparatus for a printing device, comprising:

a nozzle configured to receive waste toner from a hopper, the nozzle including:

a body;

a cavity formed in the body; and a plurality of fixed heat transfer surfaces disposed in the body and positioned substantially radially from the cavity; and a heater configured to heat the waste toner in a manner sufficient to liquefy the waste toner within the nozzle;

wherein when substantially exiting the nozzle, the liquefied waste toner solidifies and forms a solid waste toner pellet.

2. The waste toner solidification apparatus as defined in claim 1 wherein the cavity is substantially conically shaped.

3. The waste toner solidification apparatus as defined in claim 1 wherein the nozzle includes a cavity having an outlet, wherein the outlet has a diameter substantially similar to the diameter of the solid waste toner pellet.

4. The waste toner solidification apparatus as defined in claim 1 wherein the heater is an external heater surrounding at least a portion of the nozzle.

5. The waste toner solidification apparatus as defined in claim 1 wherein the waste toner solidification apparatus further comprises a transport device disposed in the cavity and configured to move the waste toner through the cavity.

6. The waste toner solidification apparatus as defined in claim 5 wherein the cavity is substantially cylindrically shaped.

7. The waste toner solidification apparatus as defined in claim 1 wherein the heater is an external heater comprising a wire connected to an electrical power supply.

8. The waste toner solidification apparatus as defined in claim 7 wherein the wire is a Nichrome wire.

9. The waste toner solidification apparatus as defined in claim 7 wherein the wire is wrapped around an outer surface of the nozzle.

10. The waste toner solidification apparatus as defined in claim 7 wherein the nozzle includes an outer surface having a plurality of grooves formed therein, and wherein the wire is disposed in the plurality of grooves.

11. A method of removing waste toner from a printing device, comprising:

delivering waste toner from a hopper to a nozzle, the nozzle including:

a body;

a cavity formed in the body; and a plurality of fixed heat transfer surfaces disposed in the body and positioned substantially radially from the cavity;

heating the waste toner using an external heater surrounding at least a portion of the nozzle and the plurality of heat transfer surfaces, wherein heating is accomplished in a manner sufficient to liquefy the waste toner in the nozzle; and solidifying the liquefied waste toner when substantially exiting the nozzle, thereby forming a solid waste toner pellet.

12. The method as defined in claim 11 wherein delivering is accomplished by:

arranging the nozzle substantially vertically with the hopper; and allowing gravity to move the waste toner from the hopper and through the nozzle.

13. The method as defined in claim 11, further comprising removing the liquefied waste toner from the nozzle using a removal device.

14. The method as defined in claim 11 wherein the hopper and the nozzle are disposed in a waste toner solidification device operatively disposed in the printing device, wherein the waste toner solidification device further includes a transport device, and wherein delivering is accomplished by moving the waste toner from the hopper and through the nozzle via movement of the transport device.

15. The method as defined in claim 11, further comprising depositing the solid waste toner pellet in a waste container.

16. The method as defined in claim 11 wherein the printing device includes a transfer belt, a drum, or combinations thereof, and wherein the method further comprises:

removing the waste toner from the transfer belt, the drum, or combinations thereof via a cleaning device; and collecting the removed waste toner in the hopper.

17. The method as defined in claim 11, further comprising cooling the liquefied waste toner when substantially exiting the nozzle, wherein cooling is accomplished using an external cooler, exposing the liquefied waste toner to ambient temperature, or combinations thereof.

18. The method as defined in claim 11 wherein solidifying is accomplished by incremental operation of the waste toner solidification device.

19. An electrophotographic printing device, comprising:

a printing apparatus configured to form images on a print media, wherein the printing apparatus generates waste toner; and an apparatus configured to convert the waste toner into solid pellets, the apparatus comprising:

a nozzle configured to receive waste toner from a hopper, the nozzle including:

a body;

a cavity formed in the body; and a plurality of fixed heat transfer surfaces disposed in the body and positioned substantially radially from the cavity; and a heater configured to heat the waste toner in a manner sufficient to liquefy the waste toner within the nozzle;

wherein, substantially when exiting the nozzle, the liquefied waste toner solidifies and forms a solid waste toner pellet.

20. The printing device as defined in claim 19 wherein the waste toner generated by the printing apparatus is in the form of a dry powder.

21. A waste toner solidification apparatus for a printing device, comprising:

a nozzle configured to receive waste toner from a hopper, the nozzle including a cavity formed therein, the nozzle being arranged substantially vertically with the hopper; and a heater configured to heat the waste toner in a manner sufficient to liquefy the waste toner within the nozzle;

wherein:

when substantially exiting the nozzle, the liquefied waste toner solidifies and forms a solid waste toner pellet;

and the apparatus is configured to allow gravity to move the waste toner from the hopper and through the nozzle without utilizing a transport device disposed in the cavity and configured to move the waste toner through the cavity.

22. The waste toner solidification apparatus as defined in claim 21 wherein the hopper includes an outlet that is substantially aligned with the cavity of the nozzle.

23. A method of removing waste toner from a printing device, the method comprising:

delivering waste toner from a hopper to a nozzle, wherein the hopper and the nozzle are disposed in a waste toner solidification device operatively disposed in the printing device, wherein the waste toner solidification device further includes a transport device, and wherein delivering is accomplished by moving the waste toner from the hopper and through the nozzle via movement of the transport device;

heating the waste toner using an external heater surrounding at least a portion of the nozzle, wherein heating is accomplished in a manner sufficient to liquefy the waste toner in the nozzle;

solidifying the liquefied waste toner when substantially exiting the nozzle, thereby forming a solid waste toner pellet; and removing the solid waste toner pellet from the nozzle by reversing the rotational movement of the transport device, using a removal device, or combinations thereof.

* * * * *